US005361620A

United States Patent [19]

Meadows

[11] Patent Number: 5,361,620

[45] Date of Patent: Nov. 8, 1994

[54] METHOD AND APPARATUS FOR HEMMING SHEETS OF METAL MATERIAL

[76] Inventor: John L. Meadows, 15 Eluira Dr., Rockfall, Conn. 06481

[21] Appl. No.: 86,943

[22] Filed: Jul. 2, 1993

[51] Int. Cl.[5] ..... B21D 5/04

[52] U.S. Cl. ..... 72/387; 72/313

[58] Field of Search ..... 72/313, 312, 314, 387, 72/388

[56] References Cited

U.S. PATENT DOCUMENTS

| | | | |
|---|---|---|---|
| 2,963,066 | 12/1960 | Nelson | 72/319 |
| 4,002,049 | 1/1977 | Randolph, Sr. | 72/388 |
| 4,181,002 | 1/1980 | Eckhold et al. | 72/387 |
| 4,434,644 | 3/1984 | Gargrove et al. | 72/387 |

FOREIGN PATENT DOCUMENTS

| | | | |
|---|---|---|---|
| 197318 | 11/1984 | Japan | 72/313 |
| 133612 | 5/1989 | Japan | 72/314 |
| 52031 | 2/1992 | Japan | 72/313 |

OTHER PUBLICATIONS

Ready Tools–Dayton, Ohio Classified Bend Design Notes, Jan. 1991, Catalog 452B.

*Primary Examiner*—David Jones

*Attorney, Agent, or Firm*—Fishmqan, Dionne & Cantor

[57] ABSTRACT

A hemming device comprises a partly cylindrical member rotatably disposed in a partly cylindrical channel of a housing block. The partly cylindrical member includes an outer surface comprising an arcuate surface portion and a planar surface portion. The housing block is disposed in a press. A sheet of metal having an upset edge to be hemmed to positioned with the edge on the planar surface which is set to an initial position. A striker is attached to a press platen of the press, whereby when the press is lowered the striker contacts the sheet forcing it against the planar surface which cause the edge to bend to an obtuse angle. As the striker continues to move downwardly, the striker contacts the partly cylindrical member (i.e., the rocker) causing it to rotate thereby further bending the edge of the sheet until a hem is formed thereat.

18 Claims, 4 Drawing Sheets

METHOD AND APPARATUS FOR HEMMING SHEETS OF METAL MATERIAL

BACKGROUND OF THE INVENTION

The present invention relates to hemming sheets of metal material. More specifically, the present invention relates to a method and apparatus for forming hems in sheets of metal material.

A hem is formed in a sheet of metal when one edge thereof is bent over onto itself. Further, it is typical that a second sheet is secured within this bend or hem. To form a hem an edge of the metal sheet is bent at angle of about 120°. This initial bend may be accomplished with any well known hemming die, for example, Accurate Brake Die Div. part numbers 130–131, 134–135 or 132–133; Verson pan nubmers V-483 and V-484; or RK part numbers H-1 through H-6. The bent edge of the metal sheet is then bent over (i.e., approaching an angle of 180°) onto the sheet by a press or other similar device, as is well known in the art. If the hem is to include a second sheet secured within the hem, the second sheet is disposed in the bend prior to the final bend with the press. When the edge is first bent to an obtuse angle a dangerous situation is often created. The press causes the sheet of metal (often held by hand) to snap up, which may result in injury to the operator.

SUMMARY OF THE INVENTION

The above-discussed and other drawback and deficiencies of the prior an are overcome or alleviated by the hemming device of the present invention. In accordance with the present invention, the hemming device comprises a partly cylindrical member rotatably disposed in a partly cylindrical channel of a housing block. The partly cylindrical member includes an outer surface comprising an arcuate surface portion and a planar surface portion. The housing block is disposed in a press. A sheet of metal having an upset edge to be hemmed to positioned with the edge on the planar surface which is set to an initial position. A striker is attached to a press platen of the press, whereby when the press is lowered the striker contacts the sheet forcing it against the planar surface which cause the edge to bend to an obtuse angle. As the striker continues to move downwardly, the striker contacts the partly cylindrical member (i.e., the rocker) causing it to rotate thereby further bending the edge of the sheet until a hem is formed thereat.

Since the hemming device of the present invention only requires a sheet having an initial bend of about 90° (i.e., the upset edge), the prior art problem of the sheet of metal snapping up during a bend of the edge to an obtuse angle (i.e., about 120°) is avoided.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DESCRIPTION OF THE PREFERRED EMBODIMENT

Figure 2:
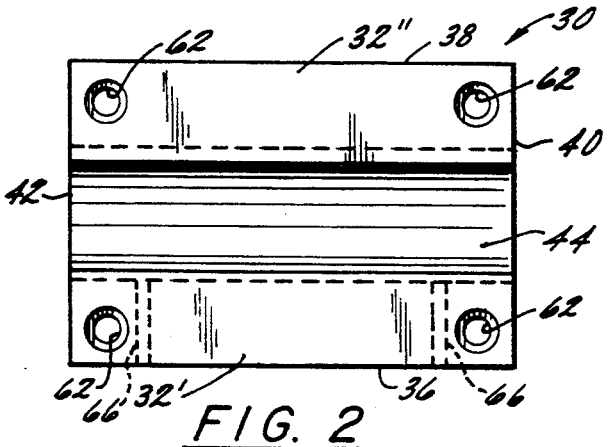
FIG. 2 is a top plan view of the housing block of FIG. 1.
Figure 1:
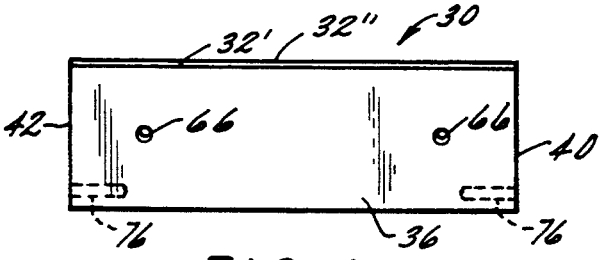
FIG. 1 is a side elevational view of the housing block of the hemming device in accordance with the present invention.
Figure 3:
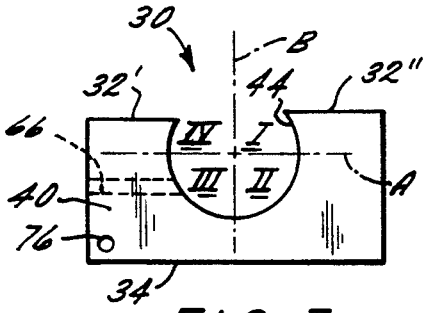
FIG. 3 is an end view of the housing block of FIG. 1.

Referring to FIGS. 1–3 a housing block is shown generally at 30. Housing block 30 is generally rectangular in shape and has a top surface 32, a bottom surface 34, side surfaces 36 and 38, and end surfaces 40 and 42. A partly cylindrical channel 44 cuts longitudinally through housing block 30 from end 40 to end 42. Channel 44 is open at top surface 32. Accordingly, surface 32 is divided by channel 44 into two parts 32' and 32''. Surface 32'' is preferably elevationally higher than surface 32', as is best shown in FIG. 3. Channel 44 is defined relative to a horizontal axis A and a vertical axis B which form quadrants I, II, III and IV. Channel 44 terminates in quadrant I at about 35°–40° from the A axis and terminates in quadrant IV at about 30°–35° from the A axis. Accordingly, channel 44 extends circumferentially about 250°. Housing block 30 is preferably comprised of tool hardened steel. The above features are preferably machined from a solid piece of steel, however, such features may be casted, as is well known in the art.

Figure 5:
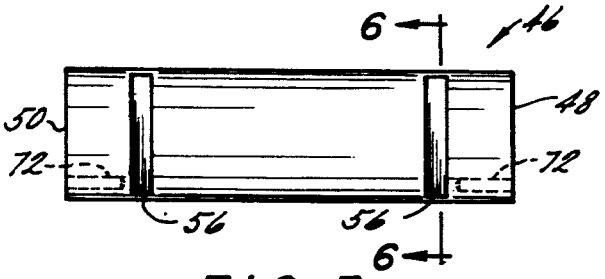
FIG. 5 is an elevational view of the partly cylindrical member of FIG. 4.
Figure 4:
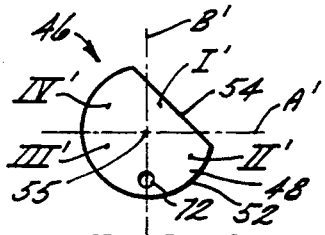
FIG. 4 is an end view of the partly cylindrical member of the hemming device in accordance with the present invention.
Figure 6:
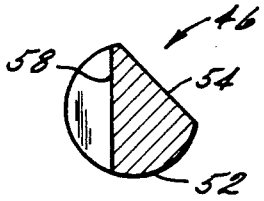
FIG. 6 is a sectional view through the line 6—6 in FIG. 5.

Referring to FIGS. 4–6 a partly cylindrical member is shown generally at 46. Member 46 comprises end surfaces 48 and 50, an arcuate surface 52 and a planar surface 54. Surface 54 is off center, designated at 55, and member 46 is always greater than one half of a complete cylinder. Arcuate surface 52 is defined relative to a horizontal axis A' and a vertical axis B' which form quadrants I'II', III' and IV'. Surface 52 terminates in quadrant II' at about 10° from the A' axis and terminates in quadrant IV' at about 10° from the B' axis. Accordingly, surface 52 extends circumferentially about 250°. Surface 54 extends between the terminating points of surface 52. Preferably the intersections of surfaces 54 and 52 are rounded (e.g., eighth inch radii). A pair of slots 56 are cut in surface 52 with each terminating in a flat surface 58. Member 46 is preferably comprised of tool hardened steel. The above features are preferably machine from a solid piece of steel, however, such features may be casted, as is well known in the art.

Referring now to FIGS. 7–10, sequential views of the hemming process in accordance with the present invention are shown. Housing block 30 is mounted to a fixed platen or base 60 of a press by a plurality of bolts (not shown) extending through recessed mounting holes 62 (FIGS. 1 and 2) in block 30. Member 46 is disposed in channel 44 with at least a portion of surface 54 exposed at surface 32. Member 46 freely rotates or rocks within channel 44.

Figure 7:
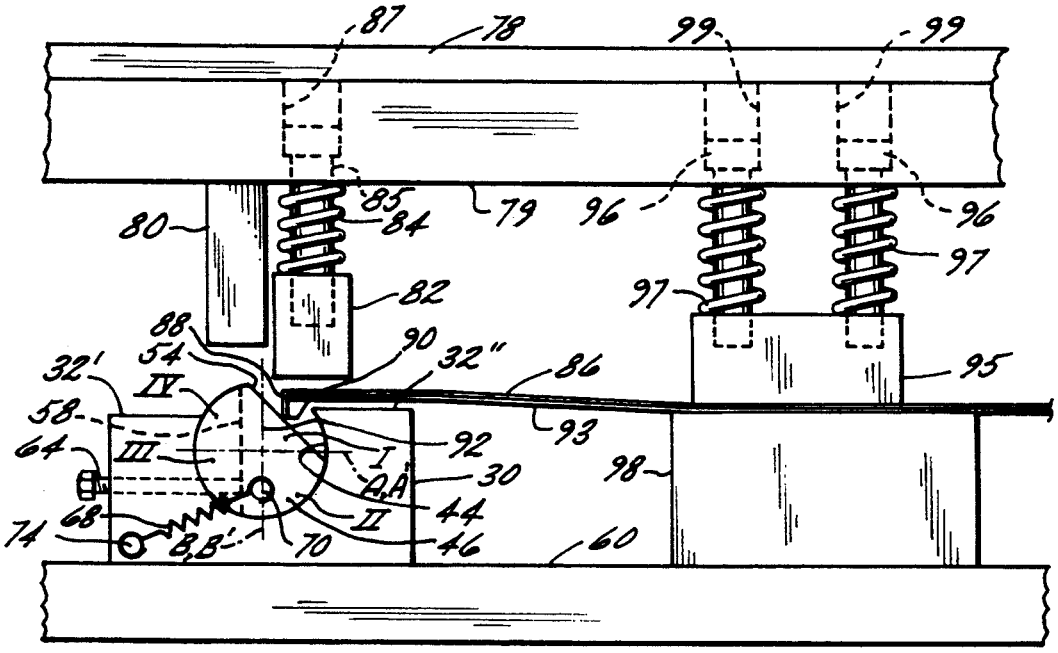
FIGS. 7–10 are side elevational sequential views showing a sheet of metal having an upset edge hemmed by the hemming device of the present invention.

A pair of screws or bolts 64 (only one of which is shown in the FIGURES) extend through threaded opening 66 (FIGS. 1 and 2) of block 30. Screws 64 (more particularly the shafts of screws 64) extend into slots 56 of member 46 with the ends thereof contacting surfaces 58 of the slots when member 46 is in its initial position, as shown in FIG. 7. In other words, the contact of the screw ends with surfaces 58 provide a stop for the clockwise rotation of member 46. However, member 46 is free to rotate or rock in the counter clockwise direction until surfaces 58 contact the sides of screws 64 (the illustration of which is not shown). Member 46 may also be referred to herein as a rocker, since surface 54 can rock between these positions. It will be appreciated that during operation surface 54 (i.e., the rocker surface) is only required to rock in the counter clockwise direction to a point where surface 54 is about level with surface 32". Rocker (i.e., member) 46 may be biased to the stopped position (FIG. 7) by a pair of springs 68 (only one is shown in the FIGURES). Springs 68 are connected to rocker 46 by screws 70 in holes 72 (FIGS. 4–6) and secured to block 30 by screws 74 in holes 76 (FIGS. 1 and 3).

A press platen 78 of the press has a carrier plate 79 attached thereto. Press platen 78 is attached to the ram of the press as is well known. Carrier plate 79 has two striker blocks 80 and 82 attached thereto. Striker 82 includes a spring 84, whereby when spring 84 is fully compressed the length of striker 80 is longer than the length of striker 82 (including spring 84) by the expected thickness of the hem. However, when spring 84 is not compressed striker 82 is longer than striker 80. Spring 84 is allowed to compress, since a pin 85 attaching striker 82 to carrier plate 79 is captured with a recess 87 of plate 79 by platen 78, thereby allowing vertical movement of striker 82.

A first sheet of metal 86 (e.g., 16 gauge) to be hemmed must first have the edge to be hemmed upset or bent to about 90°. This upset may be formed using any well known wiping die, for example, RK part number W1, W2, W3, SF-1 or SF-2. This upset end 88 is disposed within the press with the leg on the bend extending toward rocker 46. In this initial position end 90 of sheet 86 is positioned in contact with surface 54 at an offset from a plane through axis B. In this initial position surface 54 is at an angle of about 45° relative to the A axis. Further, surface 52 terminates in quadrant II' at about 10° from the A axis and terminates in quadrant IV' at about 10° from the B axis. Also, surface 58 is at angle of about 90° relative to the A axis. In FIG. 7 the A and B axis correspond to the A' and B' axis described hereinbefore. A second sheet 93 to be secured within the hem is disposed below sheet 86 adjacent thereto. A hold down plate 95 is connected to press platen 78 by fasteners 96 with springs 97. Plate 95 forces sheets 86 and 93 against a block 98 which is supported on platen 60. This prevents the sheets from shifting during the hemming process. Springs 97 are allowed to compress, since fasteners 96 are captured within recesses 99 of platen 79 by platen 78, thereby allowing vertical movement of plate 95. In this position (FIG. 7) sheet 86 is ready to be hemmed over sheet 93.

Figure 8:
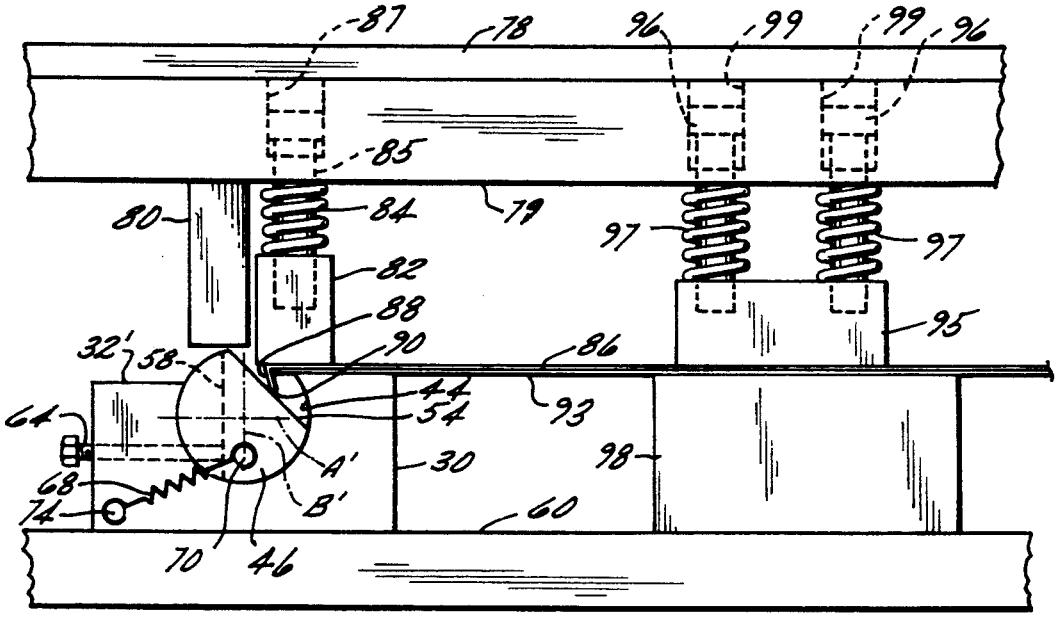

Turning now to FIG. 8, platen 78 is lowered whereby striker 82 forces sheets 86 and 93 downward onto surface 32" and leg 88 of sheet 86 is bent to an obtuse angle. Spring 84 is only slightly compressed. Striker 80 while also being lowered has not yet contacted rocker 46.

Figure 9:
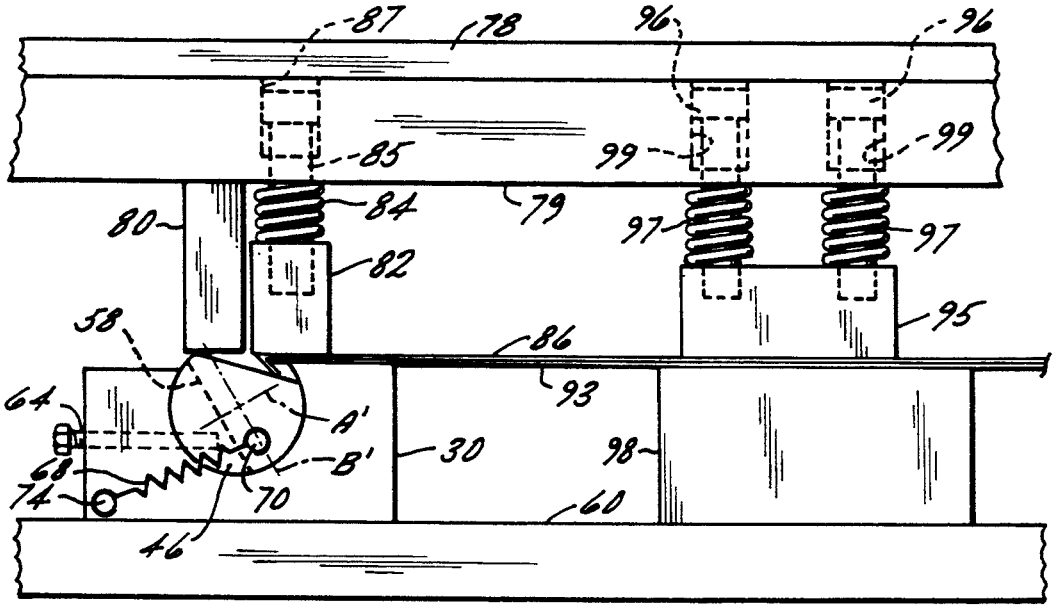

Turning now to FIG. 9, platen 78 continues to press downwardly whereby striker 80 forces rocker 46 to rotate in a counter clockwise direction. This rotation causes leg 88 of sheet 86 to further bend over onto sheet 93. Spring 84 is compressing as surface 54 pushes against leg 88.

Figure 10:
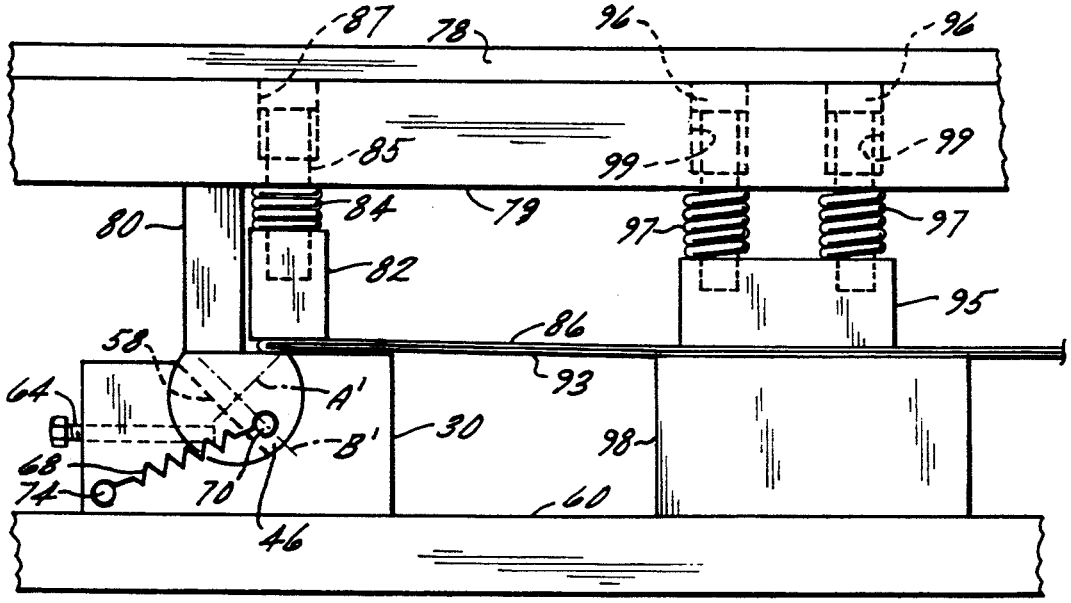

Turning now to FIG. 10, platen 78 continues to press downwardly causing striker 80 to rotate rocker 46 to a position whereby the lower surface of striker 80 is flush with surface 54 of rocker 46. In this position surface 54 is level with surface 32" of block 30. This rotation of rocker 46 causes leg 88 to completely bend over onto sheet 93 thereby forming a hem 94 with sheet 93 disposed therebetween. As discussed hereinbefore, the length of striker 80 is longer than the length of striker 82 by the thickness of the hem 94. The press is opened by raising platen 78 and sheet 86 having hem 94 with sheet 93 therein is removed. When platen 78 is raised. Spring 68 causes rocker 46 to return to its initial position (FIG. 7).

While FIGS. 7–10 are shown with a sheet 93 disposed within the hem, this could be formed without sheet 93 whereby leg 88 would be bent over onto sheet 86, itself, in the same manner describe hereinabove.

Figure 11:
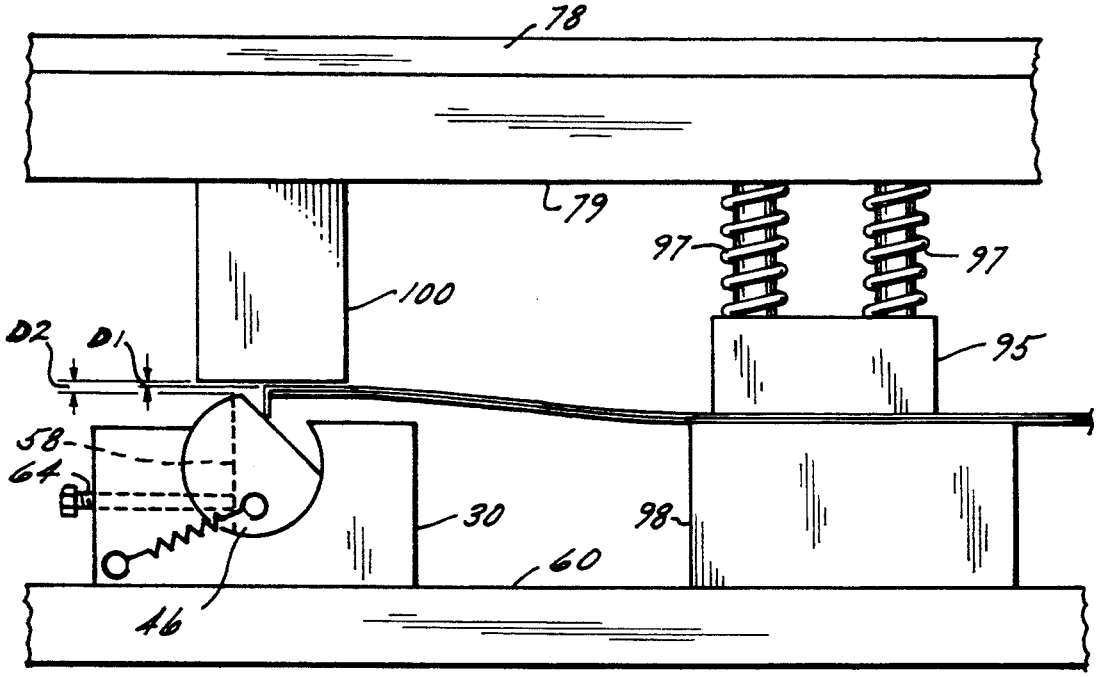
FIG. 11 is a side elevation view showing a sheet of metal having an upset edge to be hemmed by the hemming device in accordance with an alternate embodiment of the present invention.

Referring to FIG. 11, in accordance with an alternate embodiment of the present invention, a single striker 100 may be used in place of strikers 80 and 82 of the FIG. 7 embodiment. However, when striker 100 is used sheet 86 must be closer to the surface of striker 100 then member 46 (i.e., $D1<D2$). This allows the striker to bend leg 88 past 90° before member 46 begins to rotate. Otherwise, the operation of this hemming device is substantially the same as the previous embodiment described hereinbefore.

It will be appreciated that blocks 30 and 98 may be attached to press platen 78 and carrier plate 79 with the striker and hold down plate attached to the base 60. In other words the device may be invented within the press.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A device for hemming a sheet of metal having an upset edge in a press comprising:

a housing block disposed in the press, said housing block having a partly cylindrical channel extending longitudinally therein, said partly cylindrical channel having an inner circumference of greater than 180° with reference to vertical and horizontal axes, the vertical and horizontal axes having a point of intersection corresponding to a center of a cross section of a cylindrical area defining said partly cylindrical channel; and a partly cylindrical member having a cross sectional profile defined by an arcuate outer surface extending from a first position to a second position and a continuous planar outer surface extending from the second position to the first position, said partly cylindrical member disposed in said partly cylindrical channel for rotation therein, said arcuate outer surface having an outer circumference of greater than 180° with reference to said vertical and horizontal axes, wherein the center of the cross section of the cylindrical area defining said partly cylindrical channel corresponds to a center of the cross sectional profile of said partly cylindrical member.

2. The device of claim 1 further comprising:

stop means in said housing block and in said partly cylindrical member for stopping the rotation of said partly cylindrical member within said partly cylindrical channel at an initial position, said initial position comprising said planar outer surface being exposed at said channel and being at an angle relative to said horizontal axis.

3. The device of claim 2 wherein said stop means comprises.

a slot in said partly cylindrical member defining a stop surface; and a shaft extending from said housing block into said slot for engaging said stop surface to stop rotation of said partly cylindrical member at said initial position.

4. The device of claim 2 further comprising:

spring means connected between said housing block and said partly cylindrical member to bias said partly cylindrical member in said initial position.

5. The device of claim 2 wherein said angle of said planar outer surface relative to said horizontal axis is about 45° in said initial position.

6. The device of claim 3 wherein said stop surface is at an angle relative to said horizontal axis of about 90° in said initial position.

7. The device of claim 1 wherein said inner circumference of said partly cylindrical channel and said outer circumference of said partly cylindrical member are each about 250°.

8. A device for hemming a sheet of metal having an upset edge in a press, the press having a fixed base and a press platen attached to the ram of the press, comprising:

a housing block disposed on one of the base or the press platen of the press, said housing block having a partly cylindrical channel extending longitudinally therein, said partly cylindrical channel having an inner circumference of greater than 180° with reference to vertical and horizontal axes, the vertical and horizontal axes having a point of intersection corresponding to a center of a cross section of a cylindrical area defining said partly cylindrical channel;

a partly cylindrical member having a cross sectional profile defined by an arcuate outer surface extending from a first position to a second position and a continuous planar outer surface extending from the second position to the first position, said partly cylindrical member disposed in said partly cylindrical channel for rotation therein, said arcuate outer surface having an outer circumference of greater than 180° with reference to said vertical and horizontal axes, wherein the center of the cross section of the cylindrical area defining said partly cylindrical channel corresponds to a center of the cross sectional profile of said partly cylindrical member, whereby the upset edge of the sheet is disposed on said planar outer surface offset from said vertical axis;

stop means for stopping the rotation of said partly cylindrical member within said partly cylindrical channel at an initial position, said initial position comprising said planar outer surface being exposed at said channel and being at an angle relative to said horizontal axis;

striker means attached to one of the base or the press platen of the press, whereby when the press platen is lowered said striker means engages the sheet near the upset edge causing the upset edge to push against said planar outer surface with said partly cylindrical member in said initial position thereby bending the upset edge to an obtuse angle, said striker means then engages said partly cylindrical member causing said partly cylindrical member to rotate further bending the upset edge until a hem is formed at the edge.

9. The device of claim 8 wherein said striker means comprises:

a first striker attached to one of the base or the press platen for engaging said partly cylindrical member;

a second striker attached to one of the base or the press platen for engaging the sheet near the upset edge;

spring means disposed between one of the base or the press platen and said second striker, whereby said first striker has a length greater than a length of said second striker and said spring means in a compressed position by about the thickness of said hem.

10. The device of claim 8 further comprising:

a support block having a support surface, said support block disposed on one of the base or press platen of the press; and plate hold down means attached to one of the base or the press platen for holding the sheet against said support surface of said support block.

11. The device of claim 8 wherein said stop means comprises:

a slot in said partly cylindrical member defining a stop surface; and a shaft extending from said housing block into said slot for engaging said stop surface to stop rotation of said partly cylindrical member at said initial position.

12. The device of claim 8 further comprising:

spring means connected between said housing block and said partly cylindrical member to bias said partly cylindrical member in said initial position.

13. The device of claim 8 wherein said angle of said planar outer surface relative to said horizontal axis is about 45° in said initial position.

14. The device of claim 11 wherein said stop surface is at an angle relative to said horizontal axis of about 90° in said initial position.

15. The device of claim 8 wherein said inner circumference of said partly cylindrical channel and said outer circumference of said partly cylindrical member are each about 250°.

16. A method for hemming a sheet of metal having an upset edge in a press, the press having a fixed base and a press platen attached to the ram of the press, comprising the steps of:

positioning a partly cylindrical member in an initial position, said partly cylindrical member having a cross sectional profile defined by an arcuate outer surface extending from a first position to a second position and continuous planar surface extending from the second position to the first position, said partly cylindrical member rotatably disposed in a partly cylindrical channel, said partly cylindrical channel extending longitudinally in a housing block, said housing block disposed on one of the base or the press platen of the press, said partly cylindrical channel having an inner circumference and said arcuate outer surface having an outer circumference each greater than 180° with reference to vertical and horizontal axes, the vertical and horizontal axes having a point of intersection corresponds to a center of a cross section of a cylindrical area defining said partly cylindrical wherein the center of the cross section of the cylindrical area defining said partly cylindrical channel corresponds to a center of the cross sectional profile of said partly cylindrical member, said initial position comprising said planar outer surface being exposed at said channel and being at an angle relative to said horizontal axis;

positioning the upset edge of the sheet on said planer outer surface offset from said vertical axis; and lowering the press platen, striker means attached to one of the base or the press platen of the press, whereby said striker means engages the sheet near the upset edge causing the upset edge to push against said planar outer surface with said partly cylindrical member in a stop position thereby bending the upset edge to an obtuse angle, said striker means then engages said partly cylindrical member causing said partly cylindrical member to rotate further bending the upset edge until a hem is formed at the edge.

17. The method of claim 16 further comprising:the holding the sheet against an upper surface of a support block disposed on one of the base or press platen of the press.

18. The method of claim 17 further comprising: biasing said partly cylindrical member in said initial position.

* * * * *